US010421628B2

(12) United States Patent
Nakahara

(10) Patent No.: US 10,421,628 B2
(45) Date of Patent: Sep. 24, 2019

(54) SHEET CONVEYANCE APPARATUS

(71) Applicant: CANON KABUSHIKI KAISHA, Tokyo (JP)

(72) Inventor: Yasuhiro Nakahara, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/699,121

(22) Filed: Sep. 8, 2017

(65) Prior Publication Data

US 2018/0093839 A1 Apr. 5, 2018

(30) Foreign Application Priority Data

Oct. 5, 2016 (JP) ..... 2016-197422

(51) Int. Cl.

| | |
|---|---|
| ***B65H 29/58*** | (2006.01) |
| ***B65H 1/04*** | (2006.01) |
| ***B65H 5/06*** | (2006.01) |
| ***B65H 31/00*** | (2006.01) |
| ***B65H 31/24*** | (2006.01) |

(52) U.S. Cl.

CPC ..... *B65H 1/04* (2013.01); *B65H 5/062* (2013.01); *B65H 29/58* (2013.01); *B65H 31/00* (2013.01); *B65H 31/24* (2013.01); *B65H 2301/4212* (2013.01); *B65H 2404/153* (2013.01); *B65H 2404/54* (2013.01); *B65H 2404/6111* (2013.01); *B65H 2404/63* (2013.01); *B65H 2404/632* (2013.01); *B65H 2405/30* (2013.01); *B65H 2405/332* (2013.01); *B65H 2801/06* (2013.01)

(58) Field of Classification Search

CPC ..... B65H 29/58; B65H 2404/63; B65H 2404/631; B65H 2404/54

See application file for complete search history.

(56) References Cited

U.S. PATENT DOCUMENTS

| | | | | |
|---|---|---|---|---|
| 5,515,152 | A * | 5/1996 | Kuo | B65H 29/60 162/271 |
| 9,475,667 | B2 * | 10/2016 | Kodama | B65H 5/36 |
| 2014/0159303 | A1 * | 6/2014 | Suzuki | G03G 15/234 271/225 |

FOREIGN PATENT DOCUMENTS

| | | | |
|---|---|---|---|
| JP | 09-188448 | A | 7/1997 |
| JP | 2003-182907 | A | 7/2003 |
| JP | 2004-231322 | A | 8/2004 |
| JP | 2007-331931 | A | 12/2007 |
| JP | 2013-130741 | A | 7/2013 |

* cited by examiner

*Primary Examiner* — Howard J Sanders

(74) *Attorney, Agent, or Firm* — Venable LLP

(57) ABSTRACT

A sheet conveyance apparatus includes a receiving conveyance path branching into a first conveyance path and a second conveyance path. A guide member guides a sheet passing through the receiving conveyance path and is movable between a first position to guide the sheet toward the first conveyance path and a second position to guide the sheet toward the second conveyance path. A rotary member is disposed on the receiving conveyance path and configured to guide the sheet by rotating in contact with the sheet. The rotary member guides the sheet on the same side as the guide member that is on the first position, while guiding the sheet on the opposite side from the guide member that is on the second position. The sheet is conveyed in contact with both the rotary member and the guide member when the guide member is at the first position.

17 Claims, 9 Drawing Sheets

SHEET CONVEYANCE APPARATUS

BACKGROUND OF THE INVENTION

Field of the Invention

The present invention relates to a sheet conveyance apparatus configured to convey sheets.

Description of the Related Art

A sheet processing apparatus configured to perform processes such as binding processes to sheets are equipped with a plurality of processing portions, and a sheet conveyance apparatus configured to convey sheets received from an exterior to one of the processing portions. Such a sheet conveyance apparatus is normally equipped with a flap-shaped switching member configured to guide sheets toward one of conveyance paths being branched, and a conveyance route of the sheets is switched by changing a posture of the switching member.

When using a sheet conveyance apparatus having such branched conveyance paths, the curvature of the conveyance paths may cause the sheets to be rubbed against the guide member or the switching member constituting the conveyance paths, and may damage the sheets or the images formed on the sheets. Especially, if the distance from an inlet port to the switching member is shortened, for example, by omitting an inlet roller pair which is often disposed near the inlet port of the sheet conveyance apparatus, the curvature of the conveyance paths may become steeper, and damage to the sheets and the images are more likely to occur.

Japanese Unexamined Patent Application Publication No. 2013-130741 discloses an arrangement in which a plurality of rolling guides are arranged on a guide member to switch the conveyance direction of sheets. In the arrangement, a plurality of rolling guides are arranged on two side surfaces of the guide member having a triangular shape in side view, and depending on the posture of the guide member, the rolling guides arranged on one of the two side surfaces become abutted with the sheet.

However, according to the configuration disclosed in the above document, a large number of rolling guides, or rotary members, are provided on the guide member which is a movable member in itself, thereby complicating the configuration. Further, because the rolling guides are rocked when the guide member moves, causing increase of noise level generated during operation.

SUMMARY OF THE INVENTION

According to one aspect of the present invention, a sheet conveyance apparatus includes: a conveyance member configured to convey a sheet; a receiving conveyance path configured to receive the sheet conveyed by the conveyance member; a first conveyance path and a second conveyance path branched from the receiving conveyance path; a guide member configured to guide the sheet passing through the receiving conveyance path, the guide member being movable between a first position where the guide member guides the sheet toward the first conveyance path and a second position where the guide member guides the sheet toward the second conveyance path; and a rotary member disposed on the receiving conveyance path and configured to guide the sheet by rotating in contact with the sheet, the rotary member being configured so that the rotary member guides the sheet on the same side as the guide member with respect to the sheet in a case where the guide member is at the first position and that the rotary member guides the sheet on the opposite side from the guide member with respect to the sheet in a case where the guide member is at the second position, the rotary member being disposed so that the sheet is conveyed in contact with both the rotary member and the guide member in the case where the guide member is at the first position.

Further features of the present invention will become apparent from the following description of exemplary embodiments with reference to the attached drawings.

DESCRIPTION OF THE EMBODIMENTS

Now, an image forming apparatus according to the present embodiment will be described. Dimensions, materials, shapes, relative arrangements and so on of components described in the following description of the embodiments are to be changed arbitrarily according to configurations and various conditions of the apparatus to which the present invention is applied, and they are not intended to restrict the scope of the present invention.

First Embodiment

Figure 1:
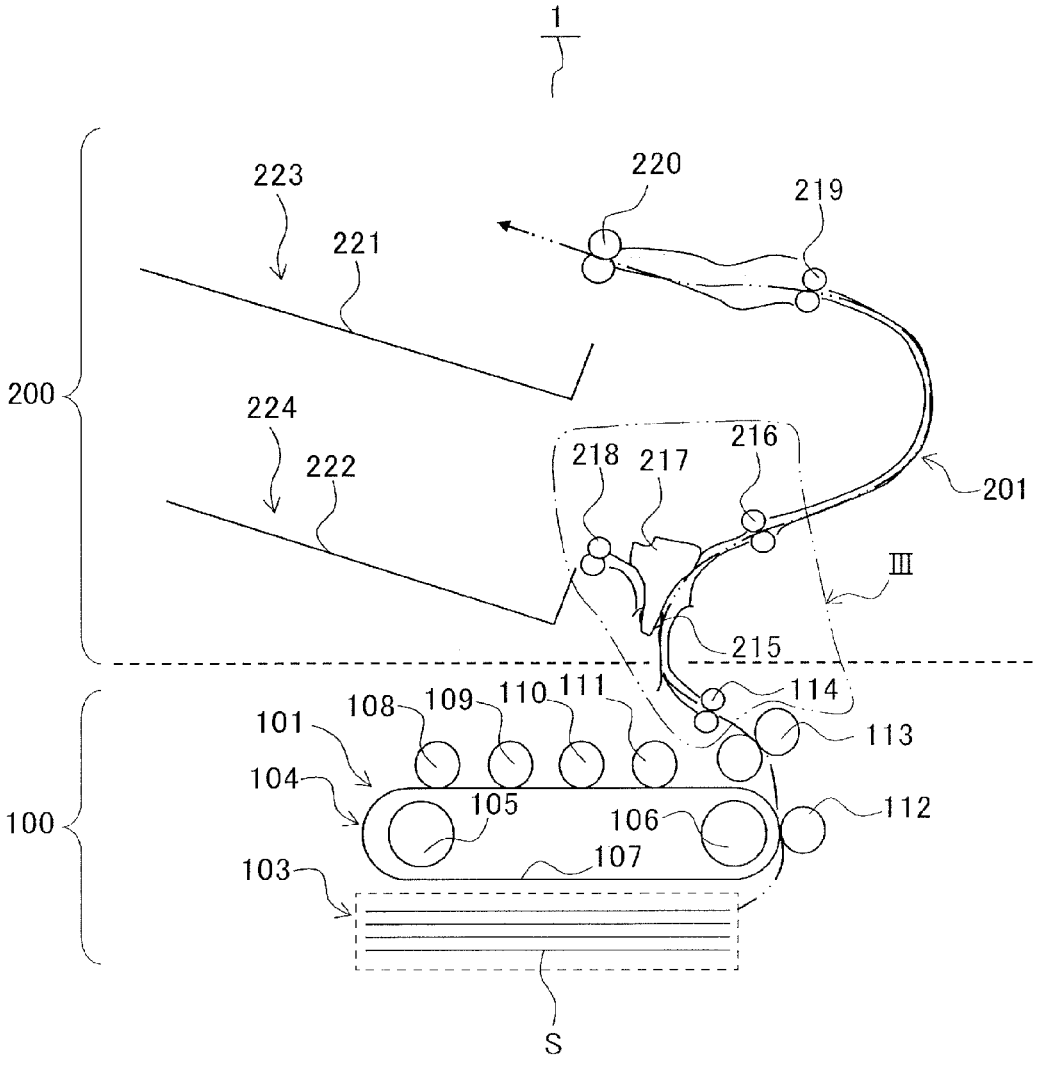
FIG. 1 is a schematic view illustrating a state in which a switching member takes a first posture in an image forming apparatus according to a first embodiment.

As illustrated in FIG. 1, a printer 1 serving as an image forming apparatus according to a first embodiment includes an apparatus body 100, and a sheet processing apparatus 200. The sheet processing apparatus 200 is either integrally assembled to or detachably attached to the apparatus body 100, which can also function alone as an image forming apparatus.

The printer 1 is an image forming apparatus equipped with a so-called intermediate transfer tandem-type image forming portion 101 including four photoconductors (108, 109, 110 and 111) within the apparatus body 100. The printer 1 forms and outputs an image on a sheet S based on image information read from a document or image information received from an external apparatus. A sheet S refers to, in addition to plain paper, a particular paper such as coated paper, a recording material having a particular shape such as an envelope or an index sheet, and a recording media such as plastic films of OHP sheets and cloth.

A charging unit, an exposure unit, a developing unit and the like (not shown) are disposed around photosensitive drums 108, 109, 110 and 111 serving as photoconductors, respectively constituting an image forming unit adopting an electrophotographic system. The configuration and operation of the respective image forming units are basically the same, except for the different toner colors used for development. That is, in a state where an image forming process is started, the respective photosensitive drums 108 through 111 are rotated, charged uniformly by the charging unit, and exposed by the exposure unit by which an electrostatic latent image is formed. The electrostatic latent image is visualized, that is, developed, by toner supplied from the developing unit, and a toner image is formed on a surface of the drum. The toner images formed on the respective photosensitive drums 108 through 111 are primarily transferred, so as to overlap each other, onto an intermediate transfer belt 107 serving as an intermediate transfer member by a primary transfer device.

The intermediate transfer belt 107 constitutes a belt unit 104 together with rollers 105 and 106 supporting an inner circumferential surface of the belt. The belt unit 104 conveys the toner image borne on the surface of the intermediate transfer belt 107 to a secondary transfer portion where the toner image is transferred onto a sheet S. The secondary transfer portion is formed as a nip portion between a secondary transfer roller 112 serving as a secondary transfer device and the intermediate transfer belt 107, and in a state where a bias voltage is applied to the secondary transfer roller 112, the toner image is secondarily transferred from the intermediate transfer belt 107 to the sheet S.

Simultaneously as the image forming process, a sheet feeding unit 103 performs a sheet feeding operation of feeding the sheet S toward the image forming portion 101. The sheet feeding unit 103 includes a sheet supporting portion such as a cassette configured to support the sheet S, and a sheet feed unit configured to feed the sheet S supported on the sheet supporting portion. The sheet S is separated one at a time by a separation mechanism adopting a retard roller system, for example, and the sheet is fed toward the secondary transfer portion.

The sheet S to which an unfixed toner image has been transferred at the secondary transfer portion is passed on to a fixing unit 113, where the sheet S is nipped by a roller pair and subjected to heating and pressing. Thereby, the sheet S to which the image has been fixed by melting and adhering or fixing of the toner is discharged to an exterior of the apparatus body 100 by a sheet discharge roller pair 114.

Sheet Processing Unit

Next, a general configuration of the sheet processing apparatus 200 will be described. As illustrated in FIG. 1, the sheet processing apparatus 200 includes an upper processing unit 223 and a lower processing unit 224, in each of which is performed a sheet processing operation. An upper tray 221 and a lower tray 222, configured to support sheets subjected to processing, are respectively disposed in the upper processing unit 223 and the lower processing unit 224. The sheet processing operation includes, for example, stapling, folding, bookbinding, aligning, and a combination of the listed processes. The sheet or sheet bundle subjected to sheet processing is discharged to an exterior of a casing of the printer 1 by a sheet discharge unit.

Figure 2:
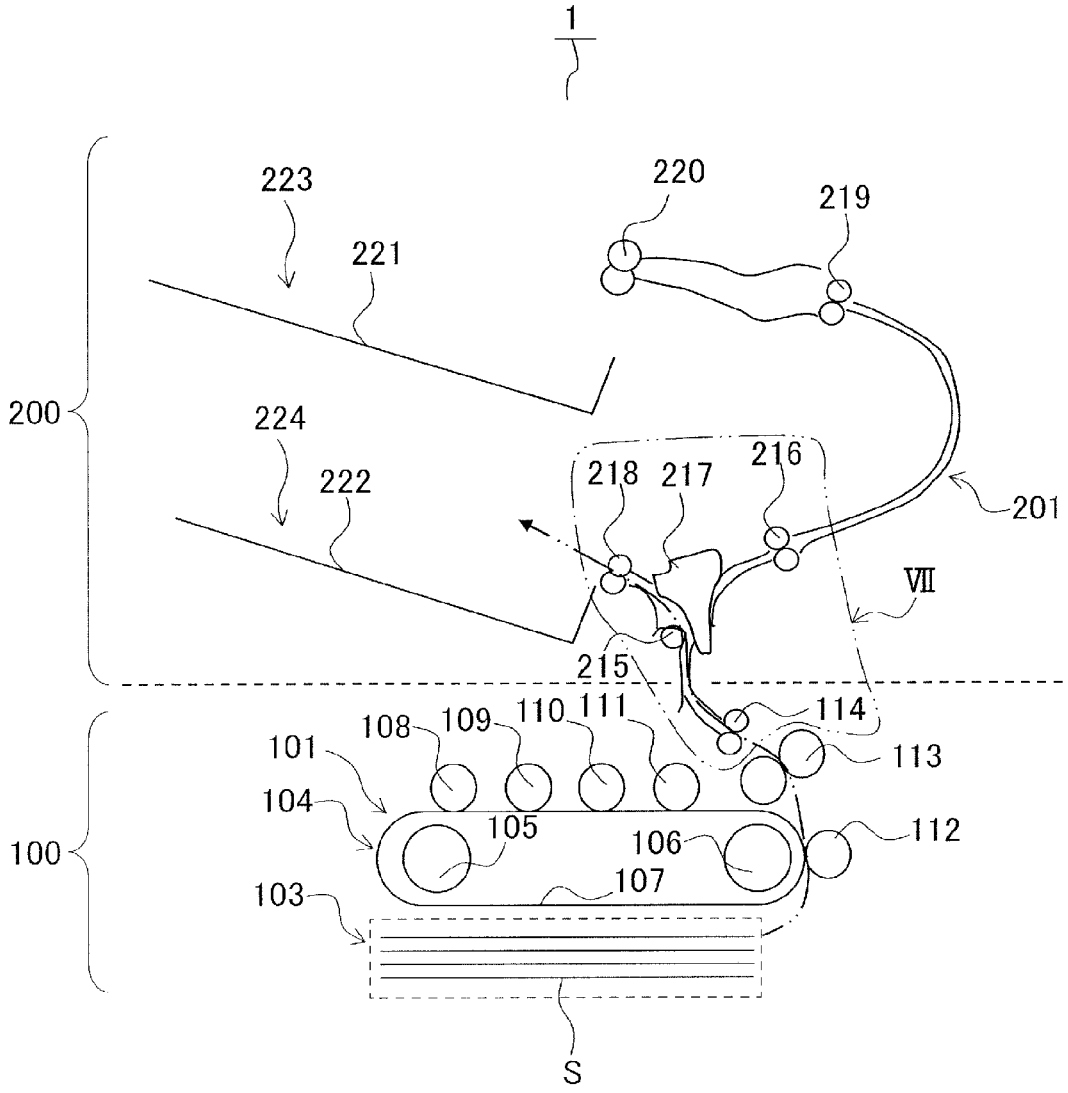
FIG. 2 is a schematic view illustrating a state in which the switching member takes a second posture in the image forming apparatus according to the first embodiment.

Further, the sheet processing apparatus 200 includes a branched conveyance portion 201 serving as a sheet conveyance apparatus configured to convey the sheet S received from the apparatus body 100 to either the upper tray 221 or the lower tray 222. As illustrated in FIGS. 1 and 2, the branched conveyance portion 201 includes a switching member 217 configured to switch conveyance paths of the sheet S between a path leading to the upper tray 221 (FIG. 1) and a path leading to the lower tray 222 (FIG. 2).

Branched Conveyance Portion

Next, we will describe a configuration of the branched conveyance portion 201 serving as a sheet conveyance apparatus according to the present disclosure. In the following description, a first surface of the sheet S discharged from the apparatus body 100 refers to the surface on which an image has been just formed by the image forming portion 101, and a second surface of the sheet S refers to the surface opposite therefrom. Further, a posture (FIG. 1) of the switching member 217 configured to guide the sheet S toward the upper tray 221 is referred to as a first posture, and a posture (FIG. 2) of the switching member 217 configured to guide the sheet S toward the lower tray 222 is referred to as a second posture.

Figure 3:
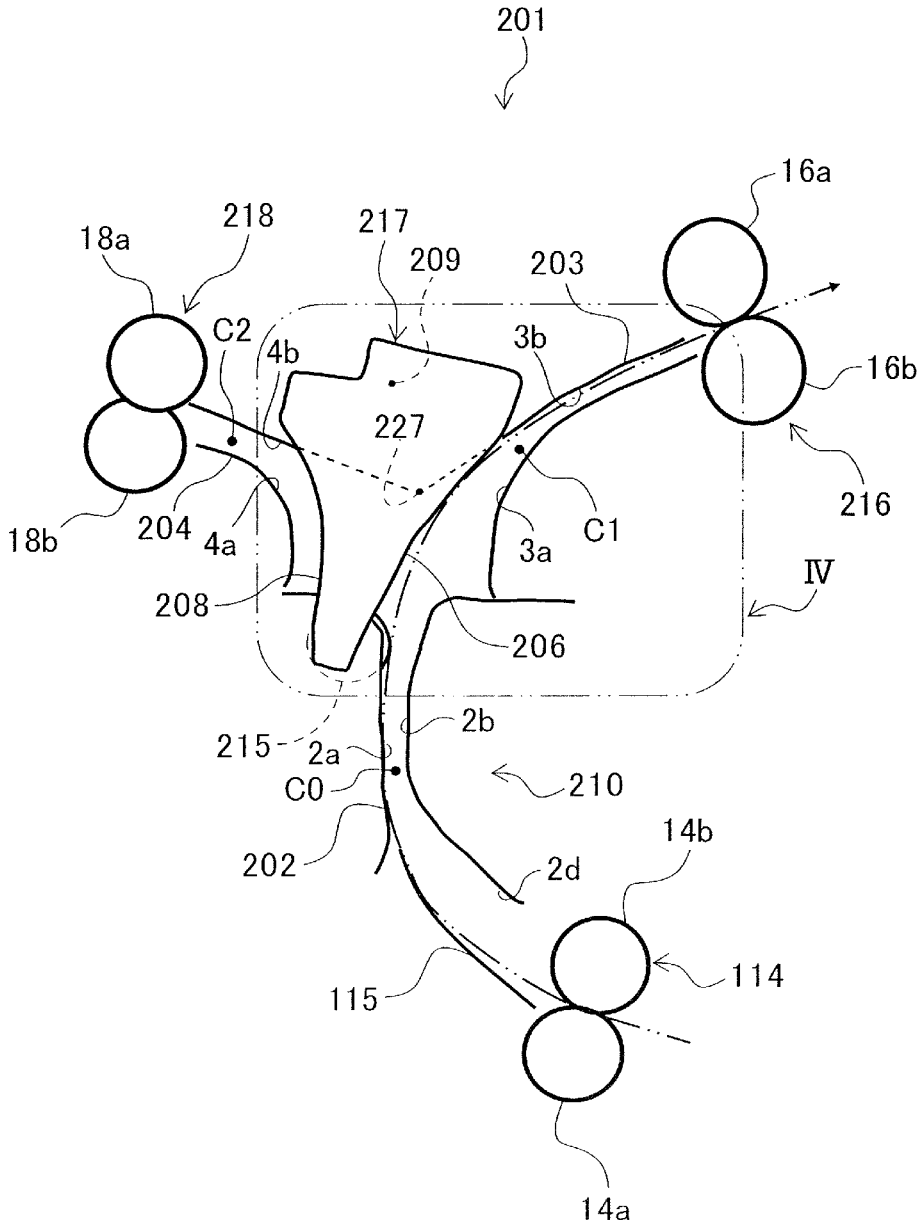
FIG. 3 is a schematic view illustrating a state in which the switching member takes the first posture in a branched conveyance portion according to the first embodiment.

As illustrated in FIG. 3, the branched conveyance portion 201 includes the switching member 217, a branching guide 210, a first conveyance roller pair 216, a second conveyance roller pair 218, and rolling members 215 described later. FIG. 3 is an enlarged view of the area surrounded by dashed lines in FIG. 1.

The sheet discharge roller pair 114, serving as a conveyance member, is disposed in the apparatus body 100 and is composed of a first sheet discharge roller 14*a* facing the first surface of the sheet S and a second sheet discharge roller 14*b* facing the second surface of the sheet S. The sheet S transmitted toward a left side in the drawing by the sheet discharge roller pair 114 is guided via a sheet discharge guide 115 curved upward toward an opening portion of the branching guide 210.

The branching guide 210 serving as a conveyance guide portion includes a receiving guide portion 202, a first guide portion 203 and a second guide portion 204. The receiving guide portion 202 is composed of a first guide surface 2*a* facing the first surface of the sheet S and a second guide surface 2*b* facing the second surface of the sheet S, by which a receiving conveyance path C0 extending approximately in the vertical direction, or the gravity direction, is formed. Further, the respective guide portions 203 and 204 are composed of first guide surfaces 3*a* and 4*a* facing the first surface of the sheet S and second guide surfaces 3*b* and 4*b* facing the second surface of the sheet S, by which a first conveyance path C1 and a second conveyance path C2 branching from the receiving conveyance path C0 are formed. In the present embodiment, the first conveyance path C1 and the second conveyance path C2 branches from the introducing path C0 and extend toward opposite directions from the introducing path C0, viewed from a direction in which the receiving conveyance path C0 extends toward a branching portion 227 where the receiving conveyance path C0 branches into the first and second conveyance paths C1 and C2.

The switching member 217, serving as a guide member, is a flap member having a first side surface 206 and a second side surface 208 as guide surfaces configured to guide the sheet S. The switching member 217 is supported pivotably in left and right directions in the drawing around a rotational axis 209 on a frame of the sheet processing apparatus 200, and the posture of the switching member 217 is changed by a driving source not shown. The rotational axis 209 is disposed downstream of the receiving conveyance path C0 in a conveyance direction of the sheet S. In a state where the switching member 217 takes the first posture, that is, first position, the first side surface 206 faces the first surface of the sheet S, and guides the sheet S passing through the receiving conveyance path C0 to the first conveyance path C1. Further, in a state where the switching member 217 takes the second posture, that is, second position (refer to FIG. 7), the second side surface 208 faces the second surface opposite from the first surface of the sheet S, and guides the sheet S passing through the receiving conveyance path C0 to the second conveyance path C2.

The first conveyance roller pair 216 serving as a first conveyance unit is arranged downstream of the first conveyance path C1 in the conveyance direction of the sheet S. Further, the second conveyance roller pair 218 serving as a second conveyance unit is arranged downstream of the second conveyance path C2 in the conveyance direction of the sheet S. The respective conveyance roller pairs 216 and 218 include first rollers 16*a* and 18*a* facing the first surface of the sheet S and second rollers 16*b* and 18*b* facing the second surface of the sheet S, and the conveyance roller pairs 216 and 218 are configured to nip and convey the sheet S guided by the switching member 217.

As illustrated in FIG. 1, the sheet S delivered toward a right direction in the drawing by the first conveyance roller pair 216 is guided along the curved conveyance guide toward a left direction in the drawing, and passed on to a conveyance roller pair 219 arranged downstream. Then, the sheet S passed on to a comb-toothed roller pair 220 from the conveyance roller pair 219 is discharged in a curved state, when viewed from the conveyance direction, by the comb-toothed roller pair 220, and stacked onto the upper tray 221. A comb-toothed roller pair refers to a roller pair arranged such that rollers arranged on one side of the conveyance path of the sheet and rollers arranged on the other side of the conveyance path are arranged in a meshed manner, that is, a pair of rollers that are arranged to be partially overlapped with one another when viewed from a width direction of the sheet, which is a direction orthogonal to the conveyance direction of the sheet. The comb-toothed roller pair 220 improves stackability of the sheet S on the upper tray 221, by enhancing stiffness of the sheet S with respect to the conveyance direction of the sheet.

Meanwhile, the second conveyance roller pair 218 itself is configured as a comb-toothed roller pair. As illustrated in FIG. 2, the sheet S guided to a left side of the drawing by the switching member 217 is discharged in a state being curved by the second conveyance roller pair 218 when viewed from the conveyance direction, and stacked onto the lower tray 222.

Curvature of Sheet Conveyance Path

Now, we will explain the effect of curvature of the conveyance path formed by the branching guide 210. As illustrated in FIG. 3, the first conveyance path C1 and the second conveyance path C2 are extended toward one direction and the other direction with respect to the receiving conveyance path C0 when viewed from the conveyance direction of the sheet S, which corresponds to approximately the gravity direction, at a middle portion of the receiving conveyance path C0. In other words, the branching guide 210 forms a Y-shaped conveyance path in which the first and second conveyance paths C1 and C2 are branched to one direction and the other direction with respect to a thickness direction of the sheet S from the receiving conveyance path C0. The respective conveyance paths C1 and C2 are formed approximately in an arc shape when viewed from the width direction of the sheet S. Further, on an upstream portion of the introduction path C0, an inclined surface 2*d* inclined toward the sheet discharge roller pair 114 is provided on an upstream portion, i.e., lower end portion, of the second guide surface 2*b* to enable smooth reception of the sheet S discharged by the sheet discharge roller pair 114 toward an upper left direction.

When adopting such a curved conveyance path, the sheet is conveyed usually in a state where either one surface or both surfaces of the sheet are in contact with the guide member forming the conveyance path. If the surface of the sheet on which the image has been formed is rubbed by being in contact with the guide member, deterioration of image quality may occur, such as by a streak mark caused by the difference in glossiness of the image between the rubbed portion and portions that have been less affected by the rubbing.

Specifically, according to the sheet processing apparatus 200 of the present embodiment, a configuration is adopted in which the sheet S is directly passed on from the sheet discharge roller pair 114 in the apparatus body 100 to conveyance roller pairs 216 and 218 downstream of the switching member 217, without arranging a conveyance roller pair, that is, an inlet roller pair, on the receiving conveyance path C0. According to the configuration, since the so-called inlet roller pair is omitted, the length of the receiving conveyance path C0 can be reduced to realize downsizing of the apparatus and simplification of the drive configuration, but the conveyance path tends to curve sharply, that is, the radius of curvature tends to be reduced.

In other words, in order for the sheet S conveyed from the exterior to the branched conveyance portion 201 serving as the sheet conveyance apparatus to reach the conveyance roller pairs 216 and 218 without fail, it is required to set the distance from the receiving conveyance path C0 to the conveyance roller pairs 216 and 218 short enough. Specifically, the distance between the sheet discharge roller pair 114 and the conveyance roller pairs 216 and 218 is set smaller than a minimum value in the conveyance direction among the sheet sizes which the apparatus body 100 can handle. Therefore, the curve of the conveyance path in the interior of the branching guide 210 becomes relatively steep, and the influence of the sheet S being rubbed against the guide member is a concern.

Then, according to the present embodiment, as illustrated in FIG. 3, a plurality of rolling members 215, each serving as a rotary member, capable of abutting against the sheet S are arranged on at least one side of the guide surfaces 2*a* and 2*b* constituting the receiving conveyance path C0. In the illustrated example, the rolling members 215 are arranged such that a rotation shaft thereof is in parallel with the width direction of the sheet S, with a portion of an outer peripheral surface of the rolling members exposed to the receiving conveyance path C0 from the first guide surface 2*a*. Therefore, the rolling members 215 come in contact with the first surface of the sheet S passing through the receiving conveyance path C0 and are rotated.

As illustrated in FIG. 3, the rolling members 215 are arranged downstream of the receiving conveyance path C0 in the conveyance direction of the sheet S. In the present embodiment, the rolling members 215 are provided at a position closer to a branching portion 227 of the first and second conveyance paths C1 and C2 than a sheet discharge roller pair 114 in the conveyance direction of the sheet S. Further, the rolling members 215 are arranged within an area overlapped with a pivoting locus of the switching member 217 when viewed from the width direction of the sheet S. That is, when viewed from the rotational axis direction of the rolling members 215, in a state where the switching member 217 takes the first posture, a portion of the rolling members 215 overlaps the switching member 217. In other words, the switching member 217 has a comb-toothed shape, or a shape in which a cutout portion is formed in the width direction, and each rolling member 215 is positioned at the cutout portion of the first and second side surfaces 206 and 208. Preferably, the rolling members 215 are arranged at positions symmetric with respect to the width direction, and at a plurality of positions in the width direction capable of coping with sheet with different sheet sizes which can be processed by the sheet processing apparatus 200.

First Route

Now, we will explain an operation of the rolling members 215 in a state where the switching member 217 takes the first posture and the second posture. At first, we will describe a case where the switching member 217 takes the first posture. In the present embodiment, in a state where the switching member 217 takes the first posture, the rolling members 215 can guide the sheet S on the same side as the switching member 217 with respect to the sheet S. In this case, a leading edge of the sheet S delivered from the sheet discharge roller pair 114 is guided sequentially by the sheet discharge guide 115, the receiving guide portion 202, the rolling members 215, the first side surface 206 of the switching member 217, and the first guide portion 203. In other words, the sheet S is conveyed while being in contact with both the rolling members 215 and the switching member 217. Then, in a state where the leading edge of the sheet S reaches the first conveyance roller pair 216, the sheet S is nipped by the first conveyance roller pair 216 and conveyed further to the upper tray 221.

Figure 4:
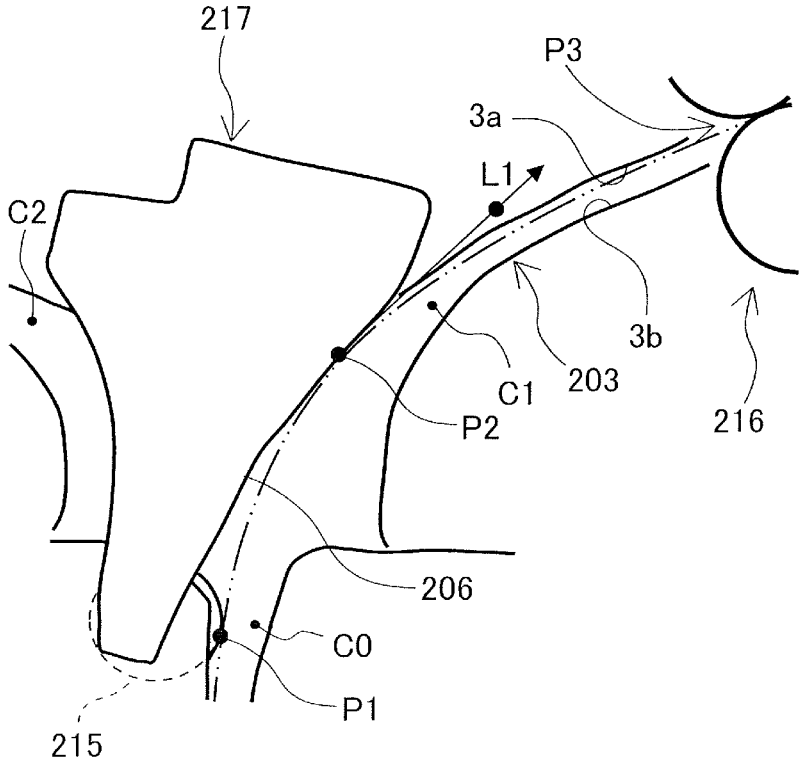
FIG. 4 is an enlarged view of an area illustrated by a dashed line in FIG. 3.

At this time, as illustrated in FIG. 4, the leading edge of the sheet S passing through the receiving conveyance path C0 is guided by the rolling members 215 toward the first conveyance path C1 to a right side in the drawing. FIG. 4 is an enlarged view of the area illustrated by the dashed line in FIG. 3. The sheet S is conveyed through a path, i.e., first route (refer to the dashed line) that passes an abutment position, i.e., contact point, P1 of the rolling members 215 to the sheet S, an abutment position, i.e., contact point, P2 of the first side surface 206 of the switching member 217 to the sheet S, and a first guide surface 3*a* of the first guide portion 203.

In a state where the switching member 217 takes the first posture, the position of the rolling members 215 are preferably set such that the leading edge of the sheet S abuts against the first side surface 206 at an angle as close as possible to a tangential direction L1 at an abutment position P2 of the first side surface 206. In that case, the force that the sheet S receives from the switching member 217, especially, the force that the leading edge of the sheet S receives from the first side surface 206 when abutting against the first side surface 206, is suppressed as small as possible, and damages of the sheet S and the image thereon can be reduced.

Figure 5:
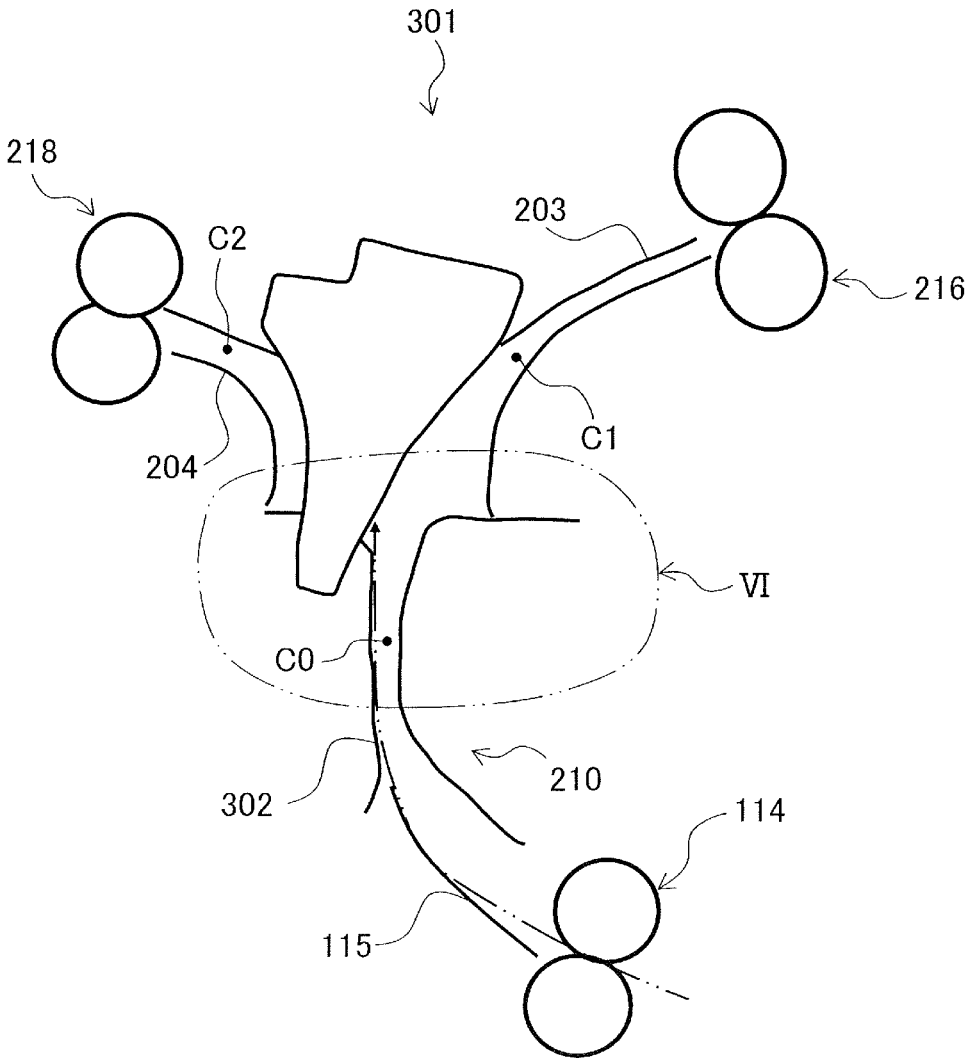
FIG. 5 is a schematic view illustrating a state in which a switching member takes a first posture in a branched conveyance portion for comparison.

Here, the influence of the curve of the conveyance path in a state where the switching member 217 takes the first posture will be described with reference to a sheet conveyance apparatus for comparison. As illustrated in FIG. 5, a branched conveyance portion 301, which is one sheet conveyance apparatus for comparison, differs from the first embodiment in that rolling members are not arranged in the receiving conveyance path C0, and the other configurations are the same as the first embodiment. Therefore, the elements that are common with the first embodiment are denoted with the same reference numbers, and descriptions thereof are omitted.

The dashed line of FIG. 5 illustrates a conveyance path of sheet S in a case where the sheet S is conveyed to the receiving conveyance path C0 from the sheet discharge roller pair 114 in a state where the switching member 217 takes the first posture in the branched conveyance portion 301 for comparison. Since rolling members adopted in the first embodiment are not arranged, the sheet S is guided by the first guide surface 2*a* of a receiving guide portion 302, and reaches the switching member 217 along the first guide surface 2*a* extending approximately in the vertical direction.

Figure 6:
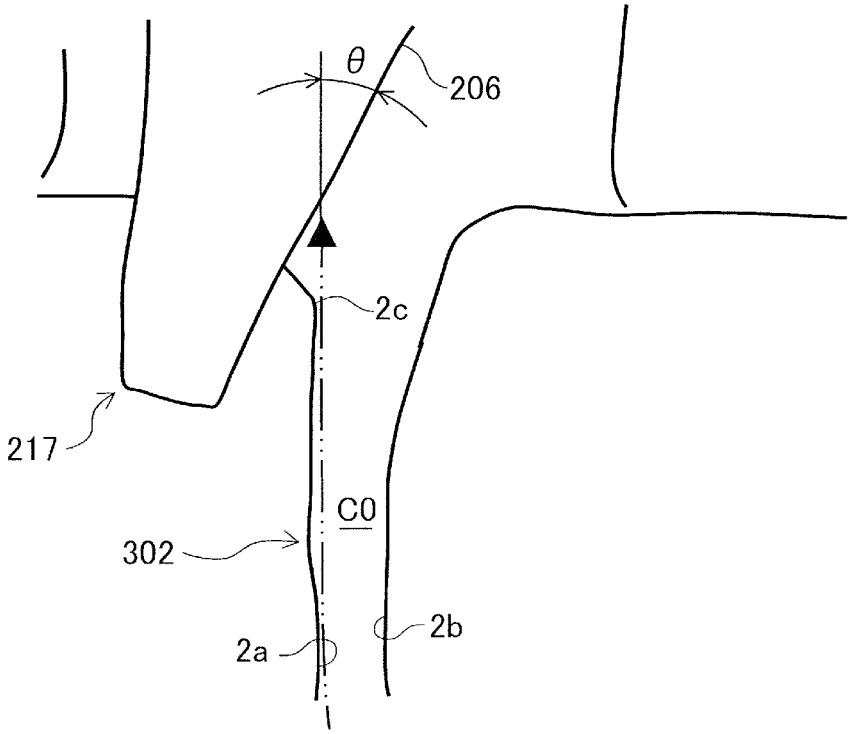
FIG. 6 is an enlarged view of an area illustrated by a dashed line in FIG. 5.

As illustrated in FIG. 6, the leading edge of the sheet S separated from the first guide surface 2*a* collides against the first side surface 206 of the switching member 217 having an inclination of angle θ with respect to the vertical direction. FIG. 6 is an enlarged view of the area illustrated by the dashed line in FIG. 5. In this example, θ equals 35 degrees, and in a state where a sheet S having a relatively small stiffness is conveyed, the leading edge portion may be buckled, and may cause jamming of the sheet. Further, in a state where a sheet S having a relatively large stiffness is conveyed, frictional force that the sheet S receives from the first side surface 206 is increased, and in order to stably covey the sheet S, it becomes necessary to use a motor having a large torque capacity as the motor for driving the sheet discharge roller pair 114, for example.

In contrast, according to the configuration of the present embodiment, the leading edge of the sheet S passing through the receiving conveyance path C0 is guided by the rolling members 215, such that the possibility of buckling of the leading edge portion of the sheet S is suppressed as small as possible. Therefore, at least compared to the branched conveyance portion 301 described above, the possibility of damaging of the sheet S and the image thereon or the occurrence of sheet jam can be reduced. Further, friction caused by the rolling members 215 between the first surface of the sheet S and the branched conveyance portion 201 is reduced, and therefore, conveyance resistance of the sheet S is reduced.

It may be considerable to provide, in the branched conveyance portion 301 for comparison, an inclined surface at a downstream portion of the first guide surface 2*a* so as to guide the leading edge of the sheet S at an angle approximated to an inclination angle of the first side surface 206, as a countermeasure for reducing collision between the leading edge of the sheet S and the first side surface 206. According to this configuration, however, in a state where the switching member 217 takes the second posture, there is fear that the first surface of the sheet S is rubbed strongly against the inclined surface. Further, it may be considerable to form the first side surface 206 of the switching member 217 to have a curved shape, such that the first side surface 206 and the first guide surface 2*a* constitute a smooth continuous surface, that is, the angle θ becomes small, in a state where the switching member 217 takes the first posture. According to this configuration, however, if the position in the first posture of the switching member 217, or a movable member, is dislocated, surface levels may differs between the first guide surface 2*a* and the first side surface 206, which may hinder conveyance of the sheet S.

In contrast, according to the configuration of the present embodiment, the buckling of the sheet S caused by collision with the switching member 217 can be prevented without affecting the conveyance of the sheet S in the state where the switching member 217 takes the second posture. Further, even if the position of the first side surface 206 in the state where the switching member 217 takes the first posture is somewhat varied, the sheet S can be conveyed stably.

Second Route

Figure 7:
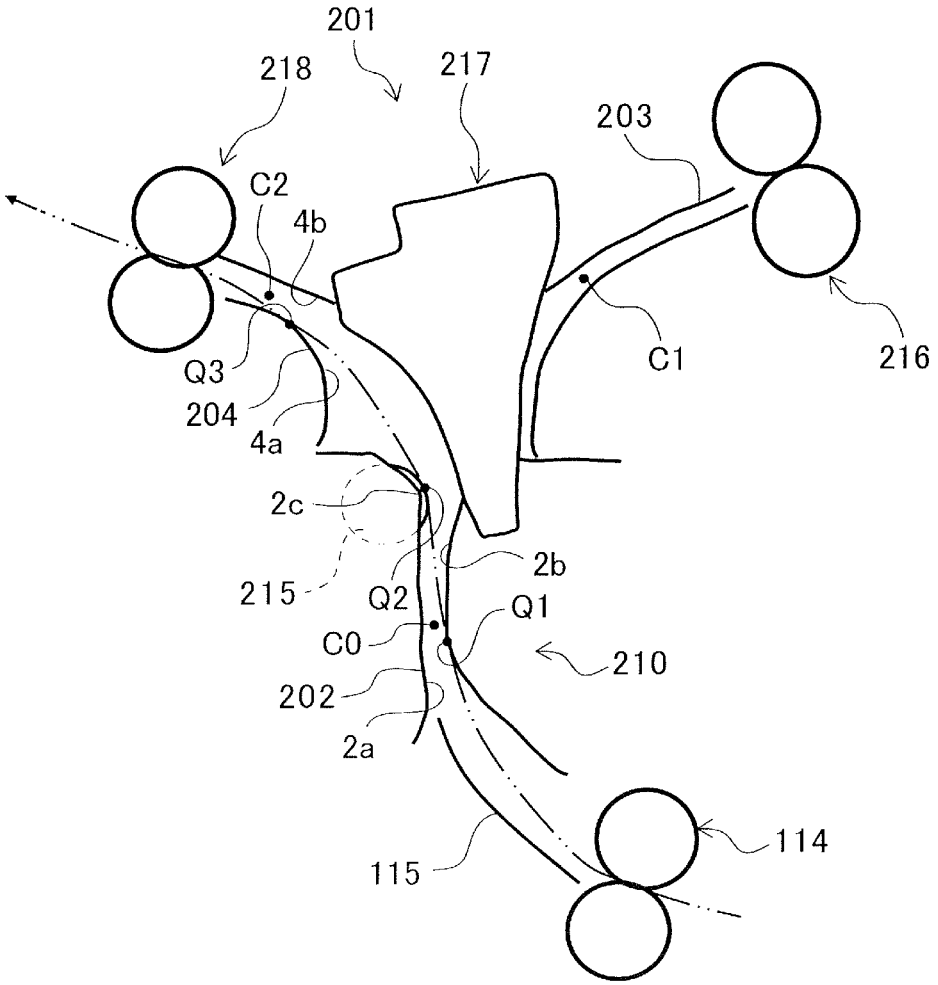
FIG. 7 is a schematic view illustrating a state in which the switching member takes the second posture in the branched conveyance portion according to the first embodiment.

Next, we will describe an example in a state where the switching member 217 takes the second posture. In the present embodiment, if the switching member 217 takes the second posture, the rolling members 215 can guide the sheet S on the opposite side from the switching member 217 with respect to the sheet S. In that case, as illustrated In FIGS. 2 and 7, the leading edge of the sheet S delivered from the sheet discharge roller pair 114 is sequentially guided by the sheet discharge guide 115, the receiving guide portion 202, the rolling members 215, the second side surface 208 of the switching member 217, and the second guide portion 204. Then, when the leading edge of the sheet S reaches the second conveyance roller pair 218, the sheet S is nipped by the second conveyance roller pair 218 and further conveyed, and discharged onto the lower tray 222. FIG. 7 is an enlarged view of the area illustrated by the dashed line in FIG. 2.

The leading edge of the sheet S passing through the receiving conveyance path C0 is guided by the second side surface 208 of the switching member 217 toward the second conveyance path C2 in the left side of the drawing. The rolling members 215 are arranged to come in contact with the first side of the sheet S on an inner side in the curved direction which is conveyed in the curved state from the receiving conveyance path C0 to the first conveyance path C1, and are rotated along with the conveyance of the sheet S.

A corner portion 2*c* formed by opening a downstream side in the conveyance direction is provided on the downstream end in the conveyance direction of the first guide surface 2*a* in the receiving guide portion 202. The rolling members 215 are arranged at a position overlapped with the corner portion 2*c* when viewed from the width direction of the sheet S, so as to prevent the first surface of the sheet S from being in contact with the corner portion 2*c*.

Figure 8:
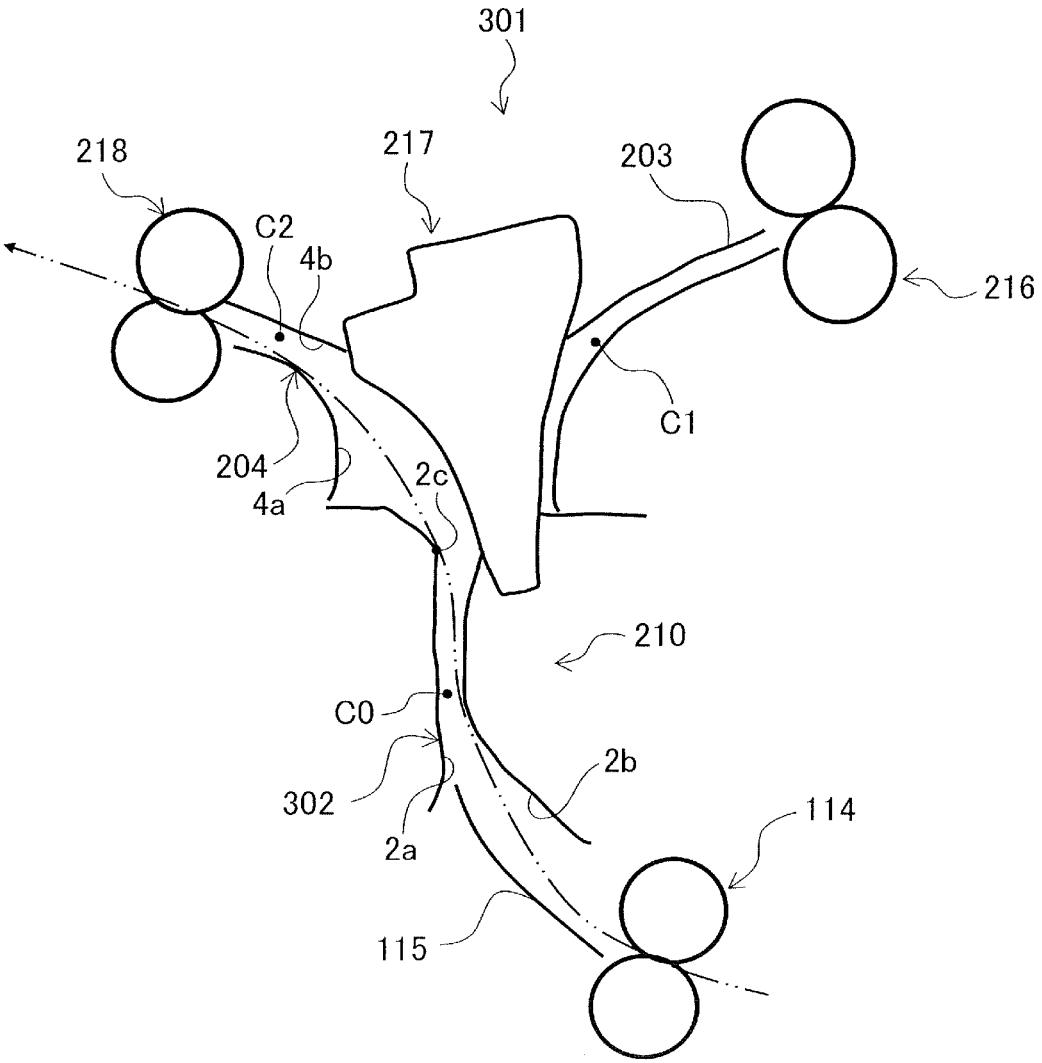
FIG. 8 is a schematic view illustrating a state in which the switching member takes a second posture in the branched conveyance portion for comparison.

If the branched conveyance portion 301 for comparison is used, as illustrated in FIG. 8, in a state where the switching member 217 takes the second posture, the first surface of the sheet S is rubbed against the corner portion 2*c* strongly, and damages such as uneven streak marks may be formed on the image on the first surface. Even if a guide portion having a smoothly curved shape is arranged instead of the corner portion 2*c*, such a guide portion may still be rubbed against the first surface of the sheet S, and may damage the image.

In contrast, according to the configuration of the present embodiment, an inner side of the curved direction of the sheet S, that is, first surface of the sheet S, curved from the receiving conveyance path C0 toward the second conveyance path C2 comes in contact with the rolling members 215, and the rolling members 215 are rotated along with the conveyance of the sheet S. Therefore, at least at a downstream portion of the receiving conveyance path C0 and the periphery thereof, occurrence of damage to the image caused by the first surface of the sheet S being rubbed against the guide member can be suppressed.

As illustrated in FIG. 7, according to the present embodiment, the sheet discharge roller pair 114 and the second conveyance roller pair 218 are respectively arranged on one side and the other side of the receiving conveyance path C0 when viewed from the conveyance direction of the sheet S in the receiving conveyance path C0, that is, from the vertical direction. Moreover, the receiving conveyance path C0 is configured to receive the sheet S being delivered by the sheet discharge roller pair 114 toward the left upper direction in the drawing by the inclined surface 2*d* provided on the second guide surface 2*b* of the receiving guide portion 202.

Therefore, the direction of curvature of the sheet S within the area from the sheet discharge roller pair 114 to the receiving conveyance path C0 and the direction of curvature of the sheet S within the area from the receiving conveyance path C0 to the second conveyance roller pair 218 are opposite, and the sheet S is conveyed in a state being curved in an S-shape (refer to the dashed line arrow). In other words, in a state where the sheet S is nipped by both the sheet discharge roller pair 114 and the second conveyance roller pair 218, a curve is formed to the sheet S such that the sign of curvature is reversed within the receiving conveyance path C0. The sheet S is conveyed through a path, i.e., second path, that passes abutment positions Q1, Q2 and Q3 sequentially from the upstream side in the conveyance direction.

As described above, according to the present embodiment, in each of the states where the switching member 217 takes the first posture and the second posture, the sheet S is conveyed while being in contact with the rolling members 215. Therefore, regardless of whether the sheet S passes the first conveyance path C1 or the second conveyance path C2 curved to one side and the other side with respect to the conveyance path C0, the rolling members 215 can work to reduce the conveyance resistance of the sheet S.

These are especially advantageous in a state where there are attempts to downsize the sheet conveyance apparatus, such as by omitting the inlet roller pair as according to the present embodiment. In other words, according to the configuration of the present disclosure, even if the curve of the sheet conveyance path becomes sharper by downsizing, the influence of the curve on the conveyance resistance can be reduced, and both downsizing and improvement of conveyance performance of the sheet conveyance apparatus can be realized.

It may be considerable to control the curve of the sheet S and reduce the contact with the guide member, for example, by controlling the conveyance speed of the first conveyance roller pair 216 and the second conveyance roller pair 218 based on the conveyance speed of the sheet discharge roller pair 114. However, in that case, a precise setting of control variable based on the arrangement of the branched conveyance portion 201, the sheet discharge roller pair 114 and so on becomes necessary, and in order to enhance accuracy, there is a need to arrange a sensor, such as a deflection sensor, for detecting the level of curvature of the sheet S. Further, in a configuration in which the inlet roller pair is omitted, as according to the present embodiment, the curvature of the sheet S would not be controlled at least until the leading edge of the sheet S reaches the conveyance roller pairs 216 and 218 on the downstream side.

In contrast, according to the configuration of the present embodiment, the occurrence of damage to the sheet S and the image on the sheet can be reduced by a simple configuration of arranging the rolling members 215 on one side of the conveyance path near the switching member 217.

The rolling members 215 are preferably arranged near the switching member 217, and for example, they are arranged at positions overlapping with a movement locus of the switching member 217 when viewed from the rotational axis direction (refer to FIG. 3). According to this arrangement, a configuration in which the rolling members 215 abut against the sheet S can be realized easily both in a state where the switching member 217 takes the first posture and where it takes the second posture. Moreover, in a configuration where one of the conveyance paths selected by the switching member 217 is curved in an S-shape, as according to the present embodiment, the rolling members 215 are arranged near the switching member 217, such that the sheet S curved along the conveyance path abuts against the rolling member 215 near a point of inflection. In that case, a contact pressure between the rolling members 215 and the sheet S is suppressed, and the occurrence of damage to the sheet S by the contact with the rolling members 215 can be suppressed as small as possible.

Further, the rolling members 215 are at least be arranged on one side of the receiving conveyance path C0, but if the rolling members 215 are arranged only on one side of the receiving conveyance path C0, they should preferably be arranged on the inner side in the direction of curvature of either the first conveyance path C1 or the second conveyance path C2 having a steeper curve. It is noted that the steepness of the curvature can be evaluated by the curvature of an arc fitted to the actual conveyance routes when viewed from the width direction of the sheet.

As illustrated in FIGS. 3 and 7, according to the present embodiment, the conveyance route of the sheet S passing the second conveyance path C2 has a somewhat greater curvature than the conveyance route passing the first conveyance path C1. Therefore, the rolling members 215 are arranged on the first guide surface 2*a* of the receiving guide portion 202 such that the rolling members 215 are placed on the inner side of the direction of curvature of the sheet S passing the second conveyance path C2. According to this arrangement, the inner side of curvature of the sheet S is supported by the rolling members 215 in the conveyance path that is required to convey the sheet S in a sharply curved state opposing to the stiffness of the sheet S, such that the conveyance resistance of the sheet S can be reduced more efficiently.

In the present embodiment, the rolling members 215 arranged on one side of the receiving conveyance path C0 are enabled to come in contact with both the sheet S passing through the first conveyance path C1 and the sheet S passing through the second conveyance path C2. However, an arrangement can be adopted where the rolling members 215 only abut with the sheet S passing through either the conveyance path C1 or the conveyance path C2. Even according to such configuration, the conveyance resistance of the sheet S can be reduced at least when the sheet S is conveyed through the conveyance path in which the sheet S abuts with the rolling member 215.

Second Embodiment

Figure 9:
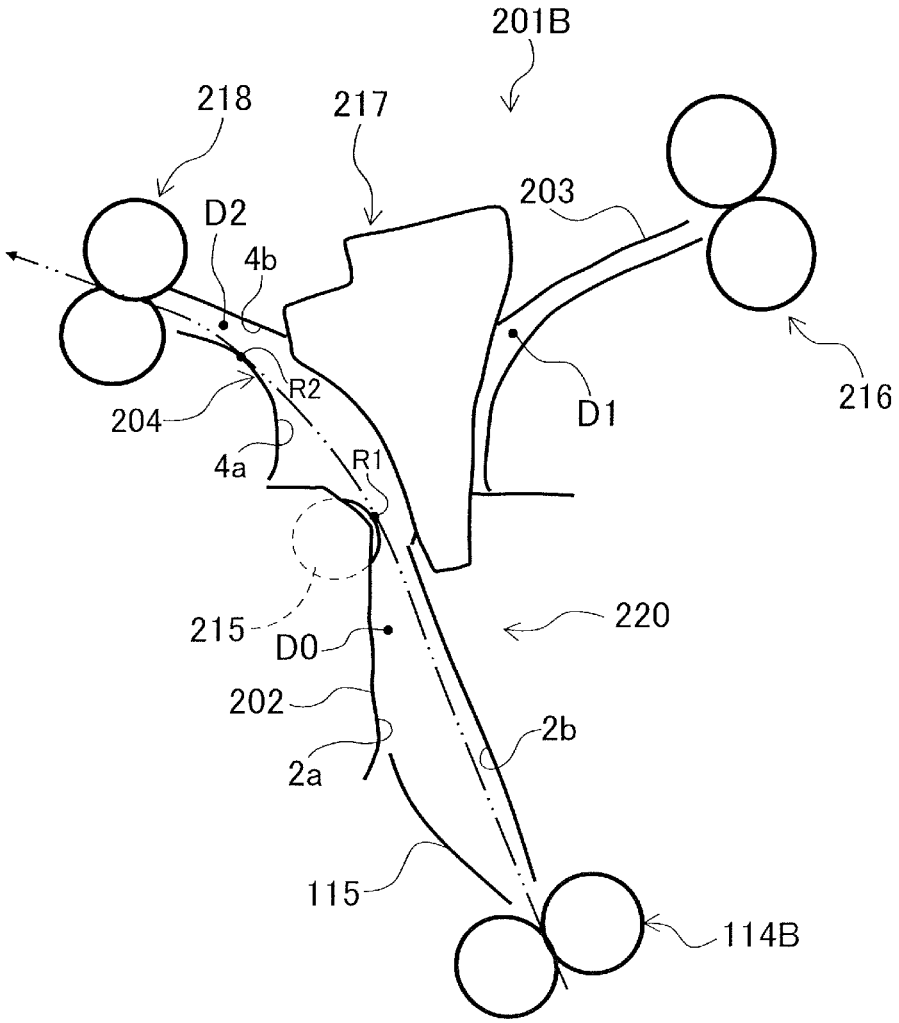
FIG. 9 is a schematic view illustrating a configuration of a branched conveyance portion according to a second embodiment.

Next, a branched conveyance portion 201B serving as a sheet conveyance apparatus according to a second embodiment will be described. As illustrated in FIG. 9, the branched conveyance portion 201B of the present embodiment differs from the first embodiment in its shape of a receiving conveyance path D0 formed by a receiving guide portion 202B, while the other configurations are similar to the first embodiment. The elements that are common to the first embodiment are denoted with the same reference numbers, and descriptions thereof are omitted.

The branched conveyance portion 201B is equipped with the receiving conveyance path D0, a branching guide 225 constituting a first conveyance path D1 and a second conveyance path D2, and the switching member 217 guiding the sheet S passing through the receiving conveyance path D0 to either the first conveyance path D1 or the second conveyance path D2. Further, the branched conveyance portion 201B includes the first conveyance roller pair 216 configured to convey the sheet S guided to the first conveyance path D1 toward the upper tray 221, and the second conveyance roller pair 218 configured to convey the sheet S guided to the second conveyance path D2 toward the lower tray 222. The rolling members 215 are arranged at an end portion downstream of the receiving conveyance path D0, that is, the corner portion 2*c*, on a side facing the first surface of the sheet S.

Here, the receiving conveyance path D0 according to the present embodiment is formed approximately linearly from a sheet discharge roller pair 114B toward an abutment position R1 of the sheet S with respect to the outer peripheral surface of the rolling members 215. In other words, the sheet discharge roller pair 114B is arranged so as to discharge the sheet S toward the abutment position R1. In correspondence therewith, the first guide surface 2*a* and the second guide surface 2*b* of the receiving guide portion 202B are arranged to ensure a space that linearly connects a nip portion of the sheet discharge roller pair 114B and the abutment position R1.

According to this arrangement, in a state where the switching member 217 takes the second posture as illustrated in FIG. 9, the sheet S will not be in an S-curved state as in the first embodiment, and the sheet S will be curved to the first surface toward the downstream side in the conveyance direction. In this case, the sheet S guided by the switching member 217 to the second conveyance path D2 will be conveyed with the first surface of the sheet S positioned on the inner side of the curvature direction abutting against the rolling members 215 and a first guide surface 4*a* of a first guide portion, that is, the abutment positions R1 and R2.

Therefore, even according to the present embodiment, similar to the first embodiment, the occurrence of damage on the sheet S conveyed through the second conveyance path D2 and the image thereon can be reduced by an action of the rolling members 215, and the conveyance resistance of the sheet S can also be reduced. Moreover, even in a state where the switching member 217 takes the first posture, similar to the first embodiment, the rolling members 215 abut with an outer side of the curvature direction, that is, first surface, of the sheet S, and reduce the occurrence of damage on the sheet S and the image on the sheet S.

Other Embodiments

According to the first and second embodiments described above, examples have been illustrated of a case where the sheet conveyance apparatus according to the present disclosure is applied as branched conveyance portions 201 and 201B assembled to the sheet processing apparatus 200 of the printer 1, but the present disclosure can be applied to other sheet conveyance apparatuses. For example, in an image forming apparatus having a duplex printing function, the present disclosure can be applied to a sheet conveyance apparatus configured to convey the sheet having an image formed on a surface thereof to either a path discharging the sheet to an exterior or a path re-conveying the sheet toward an image forming portion to execute duplex printing.

The first and second embodiments described above have been illustrated with respect to the printer 1 adopting an electrophotographic system as an example of the image forming apparatus, but the present disclosure can be applied to other image forming apparatus such as copying machines, facsimiles, and multifunction devices. The mechanism of the image forming portion is not restricted to the electrophotographic system, and it can be other mechanisms such as inkjet, thermosensitive, and dot impact.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-197422, filed on Oct. 5, 2016, which is hereby incorporated by reference herein in its entirety.

What is claimed is:

1. A sheet conveyance apparatus comprising:

an upstream conveyance member configured to nip and convey a sheet;

a receiving conveyance path configured to receive the sheet conveyed by the upstream conveyance member;

a first conveyance path and a second conveyance path branched from the receiving conveyance path;

a first support portion configured to support the sheet conveyed through and discharged from the first conveyance path;

a downstream conveyance member disposed on the first conveyance path and configured to nip and convey the sheet;

a guide member configured to guide the sheet passing through the receiving conveyance path, the guide member being movable between a first position where the guide member guides the sheet toward the first conveyance path and a second position where the guide member guides the sheet toward the second conveyance path; and a rotary member disposed on the receiving conveyance path and configured to guide the sheet by rotating in contact with the sheet, the rotary member being configured so that the rotary member guides the sheet on a same side of the sheet as the guide member in a case where the guide member is at the first position and that the rotary member guides the sheet on an opposite side of the sheet from the guide member in a case where the guide member is at the second position, wherein the upstream and downstream conveyance members are disposed, in a horizontal direction when viewed in a rotational axis direction of the rotary member, on a same side with each other with respect to a branching portion where the receiving conveyance path branches into the first and the second conveyance paths, and on an opposite side from the first support portion with respect to the branching portion, and wherein the upstream conveyance member is arranged to convey the sheet at a nip portion in a direction approaching the branching portion from the opposite side from the first support portion in terms of the horizontal direction, and the downstream conveyance member is arranged to convey the sheet at a nip portion in a direction away from the branching portion toward the opposite side from the first support portion in terms of the horizontal direction.

2. The sheet conveyance apparatus according to claim 1, wherein when viewed in the rotational axis direction of the rotary member, a part of the rotary member overlaps the guide member which is at the first position.

3. The sheet conveyance apparatus according to claim 1, wherein the guide member is configured to pivot between the first position and the second position around a rotational axis of the guide member, and wherein the rotational axis of the guide member is positioned downstream of the receiving conveyance path in a conveyance direction of the sheet.

4. The sheet conveyance apparatus according to claim 1, wherein the rotary member is located at a position, in the receiving conveyance path, closer to the branching portion than the upstream conveyance member.

5. The sheet conveyance apparatus according to claim 1, wherein when viewed in a direction in which the receiving conveyance path extends toward branching portion, the first and second conveyance paths extend toward opposite directions from the branching portion.

6. The sheet conveyance apparatus according to claim 1, wherein the receiving conveyance path includes a guide surface disposed between the upstream conveyance member and the guide member in a conveyance direction of the sheet, and an outer peripheral surface of the rotary member being protruded out of the guide surface when viewed in the rotational axis direction of the rotary member, wherein when viewed in the rotational axis direction of the rotary member, a straight line passing through the nip portion of the upstream conveyance member and extending downstream in a conveyance direction of the sheet intersects the guide surface between the upstream conveyance member and the rotary member such that a leading edge of the sheet delivered from the upstream conveyance member in the case where the guide member is at the first position such that the leading edge comes in contact with the rotary member.

7. The sheet conveyance apparatus according to claim 1, wherein the receiving conveyance path and the first conveyance path define a path in which the sheet being nipped by the upstream and downstream conveyance members is curved when viewed in the rotational axis direction of the rotary member such that an outside surface of the curved sheet is in contact with the rotary member and the guide member.

8. The sheet conveyance apparatus according to claim 7, wherein when viewed in the rotational axis direction of the rotary member, nip lines of the upstream and downstream conveyance members intersect each other on an outside of the path defined by the receiving conveyance path and the first conveyance path, the nip line of the upstream conveyance member being a straight line passing through the nip portion of the upstream conveyance member and extending in a direction in which the upstream conveyance member conveys the sheet, the nip line of the downstream conveyance member being a straight line passing through the nip portion of the downstream conveyance member and extending in a direction in which the downstream conveyance member conveys the sheet.

9. The sheet conveyance apparatus according to claim 1, wherein the upstream conveyance member is provided in a body of a first unit, and the receiving conveyance path, the first conveyance path, the second conveyance path, the guide member and the rotary member are provided in a body of a second unit that is detachably attached to the first unit.

10. The sheet conveyance apparatus according to claim 9, wherein there is no additional conveyance member driven by a driving source between the upstream conveyance member and the guide member in a conveyance direction of the sheet.

11. The sheet conveyance apparatus according to claim 9, wherein the first unit further comprises an image forming portion configured to form an image on a sheet, wherein the second unit further comprises a processing unit configured to process the sheet on which the image has been formed by the image forming portion, and at least one of the first and second conveyance paths is leading to the processing unit.

12. The sheet conveyance apparatus according to claim 1, further comprising a second downstream conveyance member disposed on the second conveyance path and configured to convey the sheet, wherein when viewed in the rotational axis direction of the rotary member, the upstream and downstream conveyance members are located on one side with respect to an extension of the receiving conveyance path and the second downstream conveyance member is located on another side with respect to the extension of the receiving conveyance path, the extension of the receiving conveyance path being a straight line passing through the branching portion and extending in a direction in which the receiving conveyance path extends toward the branching portion.

13. The sheet conveyance apparatus according to claim 1, wherein the rotary member, the upstream conveyance member, and the downstream conveyance member are disposed so that the sheet being nipped by the upstream and downstream conveyance members is conveyed in contact with both the rotary member and the guide member in the case where the guide member is at the first position.

14. The sheet conveyance apparatus according to claim 1, further comprising a second support portion configured to support the sheet conveyed through and discharged from the second conveyance path and disposed on a same side as the first support portion in the horizontal direction with respect to the branching portion, wherein the first support portion is disposed above the second support portion.

15. The sheet conveyance apparatus according to claim 1, wherein the first conveyance path is provided with a curved conveyance guide disposed between the downstream conveyance member and the first support portion and formed into a curved shape when viewed in the rotational axis direction, wherein the curved conveyance guide is configured to guide and direct the sheet, conveyed by the downstream conveyance member through the first conveyance path, in a direction approaching the first support portion in terms of the horizontal direction.

16. A sheet processing apparatus comprising:

the sheet conveyance apparatus according to claim 1; and a processing unit configured to process the sheet supported on the first support portion.

17. A sheet conveyance apparatus comprising:

an upstream conveyance member configured to convey a sheet;

a receiving conveyance path configured to receive the sheet conveyed by the upstream conveyance member;

a first conveyance path and a second conveyance path branched from a branching portion of the receiving conveyance path;

a first support portion configured to support the sheet conveyed through and discharged from the first conveyance sheet;

a first downstream conveyance member disposed on the first conveyance path and configured to convey the sheet;

a second downstream conveyance member disposed on the second conveyance path and configured to convey the sheet;

a guide member configured to guide the sheet passing through the receiving conveyance path, the guide member being movable between a first position where the guide member guides the sheet toward the first conveyance path and a second position where the guide member guides the sheet toward the second conveyance path; and a rotary member disposed on the receiving conveyance path and configured to guide the sheet by rotating in contact with the sheet, the rotary member being configured to guide the sheet on a same side of the sheet as the guide member in a case where the guide member is at the first position and to guide the sheet on an opposite side of the sheet from the guide member in a case where the guide member is at the second position, wherein when viewed in a rotational axis direction of the rotary member, the first and second downstream conveyance members are located on opposite sides from each other with respect to an extension of the receiving conveyance path, and the upstream conveyance member is located on a same side as the first downstream conveyance member, the extension of the receiving conveyance path being a straight line passing through the branching portion and extending in a direction in which the receiving conveyance path extends toward the branching portion, wherein the upstream conveyance member and the first downstream conveyance member are disposed, in a horizontal direction when viewed in a rotational axis direction of the rotary member, on a same side with each other with respect to the branching portion, and on an opposite side from the first support portion with respect to the branching portion, wherein the upstream conveyance member is arranged to convey the sheet at a nip portion in a direction approaching the branching portion from the opposite side from the first support portion in terms of the horizontal direction, and the first downstream conveyance member is arranged to convey the sheet at a nip portion in a direction away from the branching portion toward the opposite side from the first support portion in terms of the horizontal direction, and wherein the first conveyance path extends from the branching portion to the first downstream conveyance member without crossing the extension of the receiving conveyance path when viewed in the rotational axis direction, such that the receiving conveyance path and the first conveyance path define a path in which the sheet being conveyed by the upstream conveyance member and the first downstream conveyance member is curved when viewed in the rotational axis direction in the case where the guide member is at the first position and that an outside surface of the curved sheet is in contact with both the rotary member and the guide member.

* * * * *